US005190478A

United States Patent [19]

Colleran et al.

[11] Patent Number: 5,190,478

[45] Date of Patent: Mar. 2, 1993

[54] TERMINAL LOCKING MEANS FOR ELECTRICAL CONNECTORS

[75] Inventors: Stephen A. Colleran, Lisle; Richard R. Edgley, Elmhurst, both of Ill.

[73] Assignee: Molex Incorporated, Lisle, Ill.

[21] Appl. No.: 814,128

[22] Filed: Dec. 30, 1991

[51] Int. Cl.[5] ..... H01R 13/422

[52] U.S. Cl. ..... 439/595; 439/603; 439/872

[58] Field of Search ..... 439/353, 354, 357, 358, 439/592, 595, 603, 744, 871, 872

[56] References Cited

U.S. PATENT DOCUMENTS

| | | | |
|---|---|---|---|
| 4,319,797 | 3/1982 | Otani et al. | 339/75 R |
| 4,571,017 | 2/1986 | Fujita | 439/603 |
| 4,795,371 | 1/1989 | Oikawa | 439/595 |
| 4,932,899 | 6/1990 | Sueyoshi et al. | 439/595 |
| 4,948,382 | 8/1990 | Marpoe, Jr. et al. | 439/406 |
| 4,983,130 | 1/1991 | Caveney et al. | 439/407 |

*Primary Examiner*—Paula A. Bradley
*Attorney, Agent, or Firm*—A. A. Tirva

[57] ABSTRACT

An electrical connector is disclosed with a dielectric housing having a through passage for receiving a female terminal which includes a terminating end for engaging a conductor and a mating end for receiving a male terminal. A resilient locking arm is formed on the housing and is adapted to engage a locking surface on the female terminal for locking the female terminal in the passage. The locking arm is located for engagement by the male terminal upon entering the passage to prevent the locking arm from disengagement with the locking surface.

6 Claims, 2 Drawing Sheets

TERMINAL LOCKING MEANS FOR ELECTRICAL CONNECTORS

FIELD OF THE INVENTION

This invention generally relates to the art of electrical connectors and, particularly, to an electrical connector which has locking means for locking terminals in the connector housing.

BACKGROUND OF THE INVENTION

There are many electrical connectors available of a type having a locking mechanism by which male or female terminals of the connector are locked in a connector housing. The locking mechanism defines a fully inserted position of a terminal and prevents the terminal from backing out of a dielectric connector housing opposite its direction of insertion. Many such locking mechanisms are provided in the form of resilient latch arms which lockingly engage the terminals. Often, the resilient latch arms are integrally molded with the dielectric housing for pivoting in a cantilevered fashion. An example of such a locking mechanism is shown in U.S. Pat. No. 4,319,797 to Otani et al, dated Mar. 16, 1982.

Problems with locking mechanisms of the character described above are becoming increasingly prevalent due the ever-increasing miniaturization of electrical connectors and their respective housings and terminals. In fact, the miniaturization of such electrical connectors has reached a point where such locking mechanisms hardly resist even moderate pull out forces on the respective terminals. This invention is directed to solving such problems by providing a locking means or system which can withstand relatively high pullout forces on the terminals which are locked within the connector housing.

SUMMARY OF THE INVENTION

An object, therefore, of the invention is to provide a new and improved locking system for terminals in an electrical connector.

In the exemplary embodiment of the invention, an electrical connector is disclosed to include a dielectric housing having a through passage for receiving a first terminal including a mating section for mating with a second terminal. Generally, locking means are provided on the housing and adapted to engage a locking surface on the first terminal for locking the first terminal in the housing. The locking means is located for engagement by the second terminal upon mating with the first terminal to prevent the locking means from disengagement with the locking surface.

As disclosed in the preferred embodiment, the locking means is provided in the form of a resilient locking arm integrally molded with the dielectric housing and adapted to engage a recess in a female terminal for locking the female terminal in the housing passage. The female terminal is provided with a socket at its mating end for receiving a male or pin terminal. The socket has a side wall provided with the recess which lockingly engages the resilient locking arm. The arm projects through an open mating end of the socket. When the male terminal or pin is inserted into the socket, it engages the locking arm to sandwich the locking arm between the male terminal and the side wall of the socket, thereby preventing the locking arm from lifting out of the recess.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
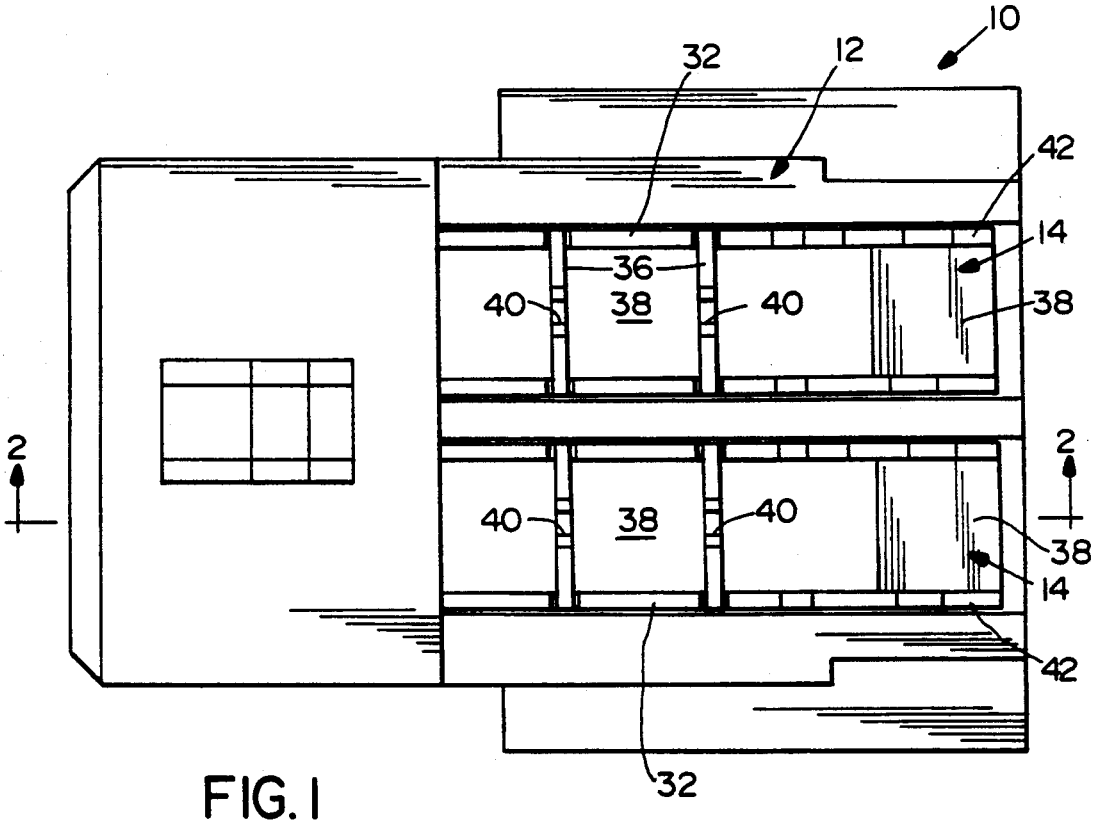
FIG. 1 is a top plan view of an electrical connector embodying the concepts of the invention.
Figure 2:
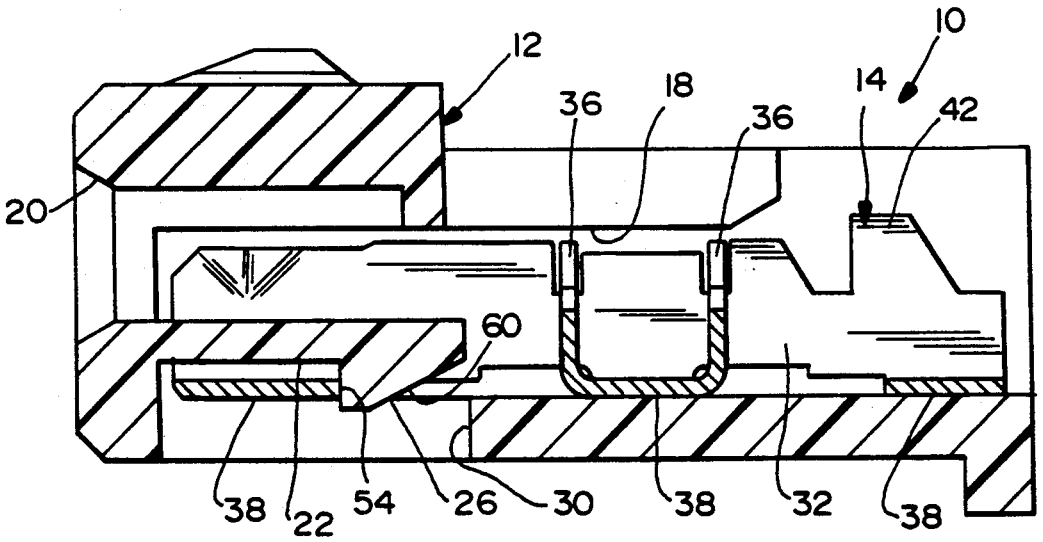
FIG. 2 is a vertical section taken generally along line 2—2 of FIG. 1.

Referring to the drawings in greater detail, and first to FIGS. 1 and 2, an electrical connector, generally designated 10, is illustrated to include a dielectric housing, generally designated 12, and a pair of female terminals, generally designated 14. Although the illustration shows an electrical connector having a pair of terminals, it should be understood that the invention is applicable for any type of electrical connector of the character described herein regardless of the number of terminals employed by the connector.

Figure 3:
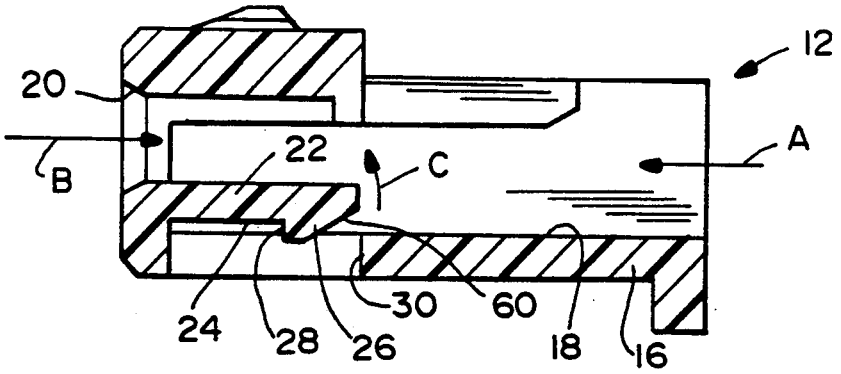
FIG. 3 is a view similar to that of FIG. 2, but with the terminal removed to facilitate an illustration of the details of the housing.

Referring to FIG. 3 in conjunction with FIGS. 1 and 2, housing 12 of electrical connector 10 includes a unitary housing 16 molded of dielectric material such as plastic or the like and including a through passage 18 for receiving each terminal 14. Each terminal is inserted into its respective passage in the direction of arrow "A" (FIG. 3). Each passage 18 includes a chamfered open end or mouth 20 at the mating end of housing 16 and through which a male terminal or pin is inserted in the direction of arrow "B" (FIG. 3) for mating with the respective terminal 14. Lastly, locking means in the form of a resilient locking arm 22 is integrally molded with housing 16 and projects rearwardly into passage 18 from open mouth 20 of the passage.

At this point, it should be noted that a bottom surface 24 of locking arm 22 is spaced above the bottom of passage 18 as can be seen clearly in FIG. 3. The locking arm has a hook portion 26 defining a forwardly facing locking shoulder 28. The bottom wall of the housing has an opening 30 to accommodate the projecting hook portion of the locking arm.

Figure 4:
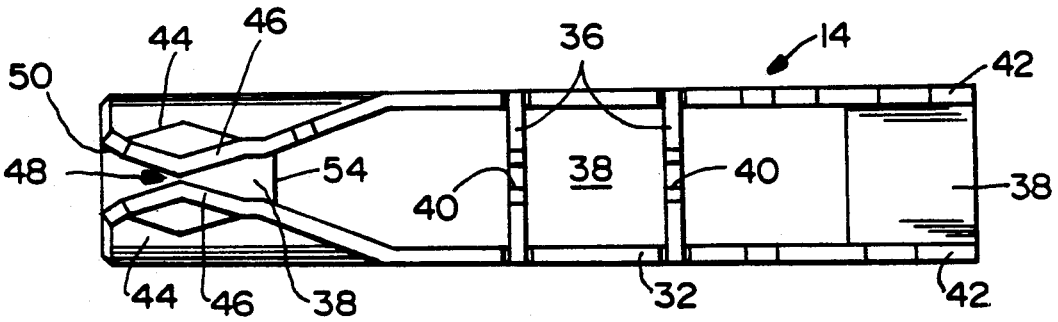
FIG. 4 is a top plan view of one of the terminals in the electrical connector of FIGS. 1 and 2.
Figure 5:
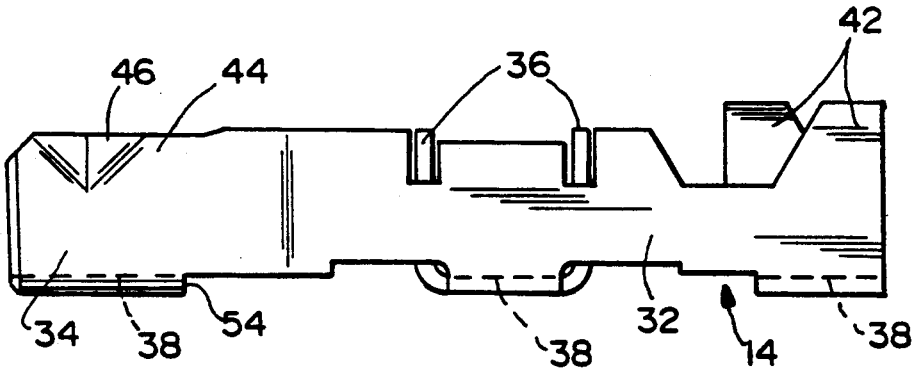
FIG. 5 is a side elevational view of the terminal.

Referring to FIGS. 4 and 5 in conjunction with FIGS. 1 and 2, each terminal 14 is a female terminal having a rear terminating end 32 and a front mating end 34. The terminal is unitarily formed as by stamping and forming from sheet metal material. The terminal has a pair of insulation displacement sections 36 stamped and formed upwardly out of a bottom wall 38 of the terminal. The insulation displacement sections have notches 40, the edges of the notches being designed to pierce through the insulation of an insulated wire and establish conductivity with the conductor core of the wire. A pair of crimp arms 42 are provided at the rear distal end of the terminal for clamping onto the outside of the insulated wire.

Each terminal 14 is generally U-shaped in cross section, and mating end 34 includes a pair of side walls 44 upstanding from bottom wall 38. The side walls are formed inwardly to define opposing dimples 46 which define a gap, as indicated at 48 in FIG. 4, for receiving a male terminal or pin therebetween. In essence, bottom wall 38 and side walls 44 define a socket for the terminal, with the socket having an open mating end 50 (FIG. 4) for receiving the male terminal or pin.

Figure 6:
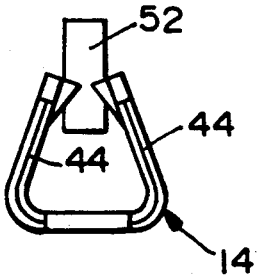
FIG. 6 is an end elevational view of the mating end of the terminal, as looking toward the left-hand end of FIG. 5, and showing a male pin inserted into the terminal mating end.

FIG. 6 shows, somewhat schematically, a male terminal or pin 52 inserted into the socket defined by mating end 34 of the terminal, the male terminal being inserted between side walls 44. Lastly, bottom wall 38 of mating end 34 of the terminal has a rearwardly facing edge 54 which defines a recess or a locking surface for cooperating with hooked latch arm 22 to lock the terminal in its passage 18 of connector housing 16, as described below.

When one of the terminals 14 is inserted into its respective passage 18 in connector housing 16 in the direction of arrow "A" (FIG. 3), the forward edge of bottom wall 38 of mating end 34 of the terminal engages a rearwardly facing chamfered surface 60 (FIG. 3) of hook portion 26 of locking arm 22. Consequently, the locking arm will be biased upwardly in the direction of arrow "C" (FIG. 3), whereupon further insertion of the terminal will cause rear edge or locking surface 54 (FIGS. 4 and 5) of the locking surface to move past locking shoulder 28 of the latch arm. The latch arm will snap back downwardly, under its own resiliency, whereupon hook portion 26 will move into the recessed area of the terminal behind locking surface 54 and lock the terminal within the housing by engagement of locking shoulder 28 on the locking arm and locking surface 54 defined by bottom wall 38 of the terminal.

Theoretically, when the terminal is fully inserted into the housing as described immediately above, pulling forces on the terminal, as by pulling on an insulated wire terminated to the terminal in a direction opposite arrow "A" (FIG. 3), will prevent the terminal from being pulled out of locking interengagement of locking shoulder 28 on the locking arm and locking surface 54 on the terminal. However, with the ever-increasing miniaturization of electrical connectors, the locking arm has difficulty resisting such pull-out forces.

Figure 7:
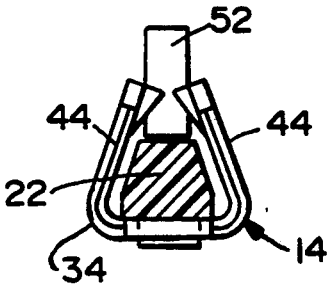
FIG. 7 is a view similar to that of FIG. 6, but showing the location of the locking arm engaged by the male terminal.

The invention solves these problems by the structural combination described above and as explained hereinafter. More particularly, FIG. 7 is a view similar to that of FIG. 6, except that the location of locking arm 22 is shown within the mating end 34 of terminal 14, and in relation to an inserted or mated male terminal or pin 52. It can be seen that, upon insertion of the male pin into the housing passage and between side walls 44 of the mating end of the terminal, the locking arm is located immediately below the male terminal or pin. Consequently, when any pull out forces on female terminal 14 in a direction opposite arrow "A" (FIG. 3), which would tend to bend locking arm 22 upwardly and release the locking engagement of the arm, the terminal pin provides a supporting backing against the top of the locking arm to prevent or at least resist disengagement of locking shoulder 28 on the locking arm from locking surface 54 on bottom wall 38 of the terminal. Of course, it can be imagined that an extremely large pull out force could cause the terminal to be pulled out of the connector regardless of any provision of any locking means and, in essence, destroy the entire connector. However, under normally expected conditions, the location of the locking arm, so as to be backed-up by the more rigid metal terminal pin, essentially prevents the locking arm from disengagement from the terminal. In essence, the resilient locking arm is sandwiched between the metallic bottom wall 38 of the terminal at the mating end thereof and the metallic male pin.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector which includes a dielectric housing having a through passage for receiving a female terminal including a terminating end for engaging a conductor and a mating end for receiving a male terminal, wherein the improvement comprises a resilient locking arm on the housing and adapted to engage a recess in the female terminal for locking the female terminal in the passage, the locking arm being located for engagement by the male terminal upon entering the mating end of the female terminal to prevent the locking arm from disengagement with the recess.

2. In an electrical connector as set forth in claim 1, wherein the housing is unitarily molded of dielectric material such as plastic, with the locking arm being integral therewith in a cantilevered configuration, the locking arm having a hook portion at a distal end thereof and adapted to be biased into the recess upon pivoting of the locking arm and wherein the recess is located in the mating end of the female terminal.

3. In an electrical connector as set forth in claim 1, wherein the mating end of the female terminal is a socket having a wall with the recess therein, and said locking arm is located inside the socket when the female terminal is inserted into the passage, whereby the male terminal upon entering the socket establishes electrical contact with the female terminal and also engages the locking arm to sandwich the locking arm between the male terminal and the wall of the socket.

4. In an electrical connector as set forth in claim 3, wherein the socket of the female terminal defines an open mating end for receiving the male terminal, and said locking arm is located on the housing for projecting into the socket through the open mating end when the female terminal is inserted into the passage.

5. In an electrical connector as set forth in claim 1, wherein the male terminal has a singular mating end.

6. An electrical connector having a housing adapted to receive a terminal, the terminal having an insulation displacement section for engaging a conductor, and a mating terminal pin receiving section, wherein the improvement comprises a resilient latching arm on the housing adapted to engage a recess in the terminal pin receiving section for locking the terminal in the housing, the latching arm positioned such that the mating pin terminal upon entering the receiving section prevents the arm from exiting the recess.

* * * * *